US011395575B2

(12) United States Patent
Woolman et al.

(10) Patent No.: US 11,395,575 B2
(45) Date of Patent: Jul. 26, 2022

(54) LINT REMOVING DEVICE

(71) Applicant: Flint Group IP Holdings Limited, London (GB)

(72) Inventors: Daniel Woolman, London (GB); Stuart Woolman, Charlotte, NC (US)

(73) Assignee: Flint Group IP Holdings Limited, London (GB)

( * ) Notice: Subject to any disclaimer, the term of this patent is extended or adjusted under 35 U.S.C. 154(b) by 157 days.

(21) Appl. No.: 16/344,752

(22) PCT Filed: Oct. 30, 2017

(86) PCT No.: PCT/EP2017/077738
§ 371 (c)(1),
(2) Date: Apr. 24, 2019

(87) PCT Pub. No.: WO2018/078153
PCT Pub. Date: May 3, 2018

(65) Prior Publication Data

US 2020/0085280 A1 Mar. 19, 2020

(30) Foreign Application Priority Data

Oct. 31, 2016 (GB) ..... 1618338

(51) Int. Cl.
*A47L 25/00* (2006.01)
*B08B 7/04* (2006.01)

(52) U.S. Cl.
CPC ..... *A47L 25/00* (2013.01); *B08B 7/04* (2013.01)

(58) Field of Classification Search
CPC .... A47L 25/005; A47L 25/00; A47L 11/4013; A47L 13/08; B05C 17/0222;
(Continued)

(56) References Cited

U.S. PATENT DOCUMENTS 2,542,774 A * 2/1951 Hutchinson ..... A47L 25/005 220/817
4,422,201 A * 12/1983 McKay ..... A47L 25/005 15/104.002
(Continued)

FOREIGN PATENT DOCUMENTS

DE 1993135 9/1968
DE 2044896 * 3/1971
(Continued)

OTHER PUBLICATIONS

Search Report and Written Opinion, dated Apr. 12, 2018, corresponding to International Application No. PCT/EP2017/077738 (filed Oct. 30, 2017), parent of the present application, 18 pp.

*Primary Examiner* — Robert J Scruggs
(74) *Attorney, Agent, or Firm* — Leydig, Voit & Mayer, Ltd.

(57) ABSTRACT

A device for removing lint, the device comprising: a housing; a roller for holding a roll of lint-removing material; wherein the roller and the roll of lint-removing material are dimensioned and configured to be housed by the housing, wherein the roller and housing are arranged such that the roller is deployable from the housing; and an actuator coupled with or formed by either the roller or the housing, the actuator being manipulate by a user to deploy the roller; and characterised in that the housing comprises a first element comprising a handle and a first housing portion and wherein the housing further comprises at least one rotatable housing portion which is rotatable with respect to the first housing portion in order to house or deploy the lint roller respectively.

20 Claims, 6 Drawing Sheets

(58) Field of Classification Search
CPC . B05C 17/0225; B05C 17/02; B05C 17/0205; B05C 17/0217; B05C 17/022; E01H 1/12; E01H 2001/1293; B08B 7/04
USPC ..... 15/104.002, 230.11, 248.2; 492/13, 19
See application file for complete search history.

(56) References Cited

U.S. PATENT DOCUMENTS

| | | | | |
|---|---|---|---|---|
| 4,571,769 | A * | 2/1986 | Ford | A45D 34/041 15/104.94 |
| 8,904,588 | B2 | 12/2014 | Taub | |
| 2005/0183223 | A1 | 8/2005 | Cheng | |
| 2011/0078866 | A1* | 4/2011 | Panthofer | A47L 25/005 15/104.002 |
| 2012/0284939 | A1 | 11/2012 | Anderson | |
| 2013/0205522 | A1* | 8/2013 | Butts | B08B 7/04 15/104.002 |
| 2015/0107038 | A1* | 4/2015 | Lee | A47L 25/005 15/104.002 |
| 2016/0256034 | A1* | 9/2016 | Woolman | A47L 25/005 |

FOREIGN PATENT DOCUMENTS

| | | | |
|---|---|---|---|
| EP | 0966915 | | 12/1999 |
| GB | 2257618 | | 1/1993 |
| JP | S5787657 | | 5/1982 |
| JP | S6368969 | | 5/1988 |
| JP | 3092551 | | 3/2003 |
| JP | 2003-190066 | * | 7/2003 |
| JP | 2007319462 | | 12/2007 |
| WO | WO 83/01734 | | 5/1983 |

* cited by examiner

LINT REMOVING DEVICE

CROSS-REFERENCE TO RELATED APPLICATIONS

This application is a U.S. National Stage Application filed under 35 U.S.C. § 371 of International Application No. PCT/EP2017/077738, filed Oct. 30, 2017, which claims the benefit of Great Britain Application No. 1618338.6, filed Oct. 31, 2016. Both of these applications are hereby incorporated by reference in their entireties.

The present invention relates to a device for removing lint.

Commonly, lint is known as meaning short fine fibres, which separate from cloth and other materials and which can lie on the surface of clothing and other surfaces. A variety of methods for lint removal are known in the art. A commonly used known lint remover consists of a roll of a lint-removing adhesive-bearing material rotatably mounted on a spindle, attached to a handle. In use, the user rolls the lint remover around the spindle over or along the surface of an object and any lint on the surface adheres to the lint-removing adhesive material. Lint rollers may also pick up and remove other materials such as hairs including pet fur, dust and other particles. In this specification, the word "lint" is intended to encompass all of these materials.

The lint-removing material is provided in a roll, so that once an area of the material has been used up, and is no longer sticky because it is covered with lint, the used-up area can be torn off to reveal a new unused area below. The roll can be perforated into discrete sheets that can be torn off. Alternatively, the discrete sheets of a roll may not contain perforated parts between them but the roll may comprise discrete sheets simply placed next to one another around the roll. As known in the art, the sheets have a backing and a pressure sensitive adhesive (PSA) used as the sticky material on the sheets can adhere to the backing of the sheets, when rolled, but may be pulled apart by a user. In other words, the sticking force of the PSA on the backing can be overcome by a user removing one sheet from the roll. Preferably, the sheet may be perforated or separated on a bias with respect to the roll, i.e. diagonally.

However, there are several problems with known lint removers. The known arrangements are quite large and not easily portable. As the lint-removing adhesive material is always exposed around the roll, the lint-removing adhesive material can pick up any dirt or unwanted material, particularly when being transported. This renders the adhesive less effective for lint-removing and also very unsightly as the adhesive is covered in lint, hair, dirt and debris. Furthermore this means that more sheets of lint-removing sticky materially are used. Additionally, known lint rollers do not provide a good user experience. Some examples of known lint roller assemblies are disclosed in GB2257618 (A) and EP0966915 (A1).

Some efforts have been made to overcome these problems, for example US patent publication 2011/0078866 A1 discloses a transportable lint remover. However this application does not fully address the problems mentioned above as the lint remover is bulky and difficult to operate.

US patent publication 2012/0284939 A1 discloses a further roller assembly which includes a separate case in the manner of a spectacles case and is therefore rather bulky.

Furthermore US patent publication 2005/0183223 A1 discloses a roll of adhesive-coated material within a hinged housing.

A further prior art lint remover is described in international patent publication WO 83/01734. In this arrangement the roll of lint is also included in a split or divided casing.

Further prior art lint removers are disclosed in German publication DE 1993135 U and Japanese patent publication JP 2007319462 A.

The present invention relates to an improved device for removing lint, in particular to a device in which the sticky lint-removing material is housed and protected when not being used. This allows the device to be more easily transported, for example in a user's bag, and the lint-removing material is only deployed from the device when needed.

According to the present invention there is provided a device for removing lint, the device comprising a housing having at least one housing section that can be rotated around the remainder of the housing section to expose a lint roller.

Conveniently the housing section forms an actuator which is manipulable by a user to deploy the lint roller.

Preferably the device is provided with an actuator which is rotatable with respect to a generally central axis of the device in order to deploy the lint roller for use.

The present invention also provides a device for removing lint, the device comprising:

- a housing;
- a roller for holding a roll of lint-removing material;
- wherein the roller and the roll of lint-removing material are dimensioned and configured to be housed by the housing, wherein the roller and housing are arranged such that the roller is deployable from the housing; and
- an actuator coupled with or formed by either the roller or the housing, the actuator being manipulable by a user to deploy the roller;
- and characterised in that the housing comprises a first element comprising a handle and a first housing portion and wherein the housing further comprises at least one rotatable housing portion which is rotatable with respect to the first housing portion in order to house or deploy the lint roller respectively.

Preferably the device comprises two rotatable housing portions.

Conveniently the actuator comprises a rotatable element configured to rotate the or each rotatable housing portion or portions.

Advantageously the device further comprises an axial spindle which is connected to or formed with the first housing element and wherein the axial spindle is provided with means to engage the or each rotatable housing portions and cause the or each rotatable housing portions to rotate.

Preferably the axial spindle is provided with a traveller having a projection, the traveller being connected to or formed with the actuator and the projection being configured to engage with a corresponding slot in at least one rotatable housing element thereby causing the rotation thereof in use.

Conveniently the traveller is moveably seated in a circumferential slot of the spindle.

Advantageously the corresponding slot in the at least one rotatable housing element is a circumferential slot.

Preferably the device comprises a first and a second rotatable housing element, wherein the projection engages with the first rotatable housing element and wherein the first rotatable housing element itself is provided with a projection configured to engage with a corresponding slot in the second rotatable element, thereby causing the second element to rotate when the first element is rotated.

Conveniently at least one of the handle portion and the or each housing rotatable elements is provided with a friction fit with respect to a neighbouring component, the friction fit requiring positive pressure to overcome and thereby preventing inadvertent rotation.

Advantageously the friction fit is provided between the first housing portion and a housing rotatable portion, and/or wherein two housing rotatable portions are provided, between the two housing rotatable portions.

Preferably the inner surface of the first housing portion and/or the at least one rotable housing portion comprises a plurality of projections.

Advantageously the projections are ridges parallel to the axis of rotation of the rotable housing portion or portions.

Conveniently the projections are ridges non-parallel to the axis of rotation of the rotable housing portion or portions.

Preferably the projections are upwardly projecting fingers.

Advantageously, the housing has a long axis and the projections extend along the inner surface over the entire long axis of the housing, or wherein the projections extend along the inner surface over part of the long axis of the housing, or wherein the projections extend along the inner surface over multiple parts of the long axis of the housing.

Conveniently the device also comprises a cap.

Preferably the cap is removably attachable to the roll of lint-removing material, for example by way of a snap fit or friction fit.

Advantageously the cap is rotatably connectable to a male connector provided at a distal end of the roller.

The invention also provides a kit comprising the claimed device and a roll of lint-removing material.

The invention further provides a kit comprising a roll of lint-removing material and a cap suitable for use with the claimed device.

Aspects of the invention will now be described with reference to the attached drawings, in which.

The general concept of the present invention is a cylindrical lint roller device having a protective housing, where the housing surrounds a rotatable roll of lint-removing material when the device is not being used. In use, the protective housing rotates to open and reveal the lint-removing material, thereby deploying the roll of lint-removing material. The roll is rotatably mounted on a roller, which allows the roll to freely rotate in use.

Figure 1A:
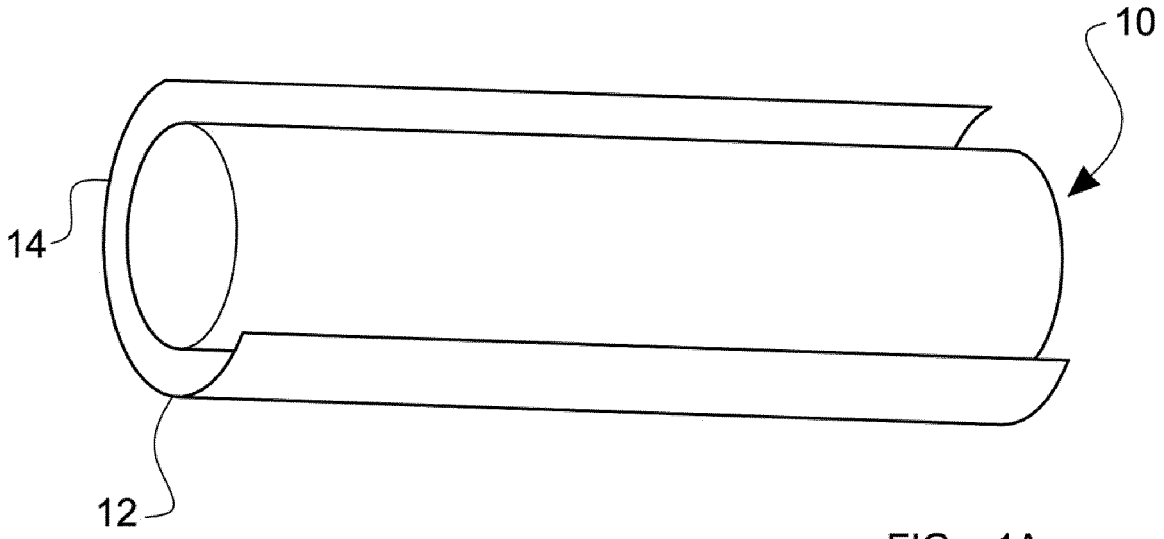
FIG. 1A is a perspective view of an arrangement of the invention.
Figure 1B:
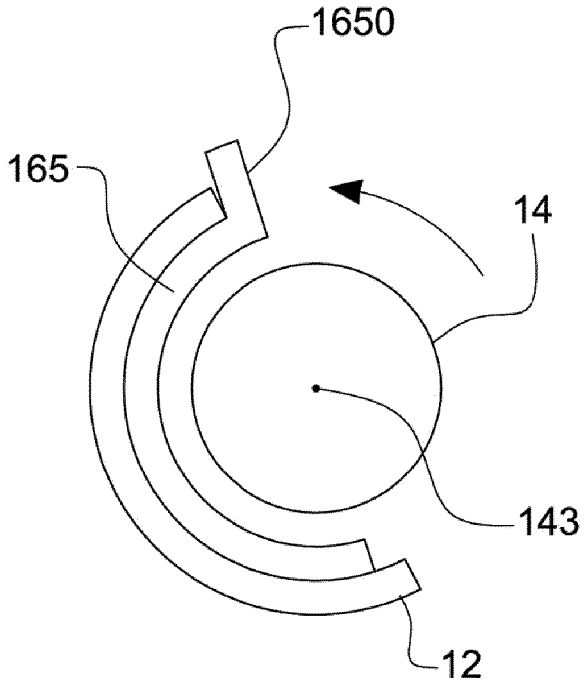
FIGS. 1B-1C are cross-sectional views of the arrangement of FIG. 1A.

As shown in FIGS. 1 A-C the housing 12 of the device 10 may have at least one section 165 that can be rotated around the remainder of housing 12 to expose the roller 14. In this arrangement it is housing section 165 which can form the actuator, as depicted in FIG. 1B. When actuator 165 is rotated around a generally central axis 143, to be housed partially or fully within the housing 12, a portion of the roller 14 is hence deployed for use, as shown in FIG. 1B.

Figure 1C:
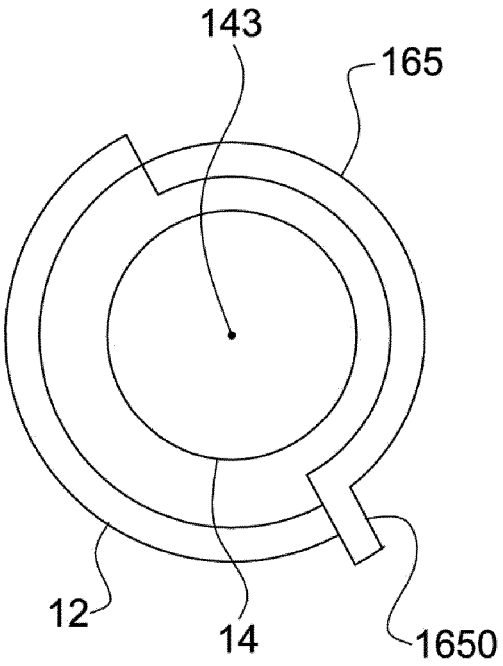

When the actuator 165 is rotated in the reverse direction about the axis, it forms fully the cylindrical housing 12, so that the roller 14 is un-deployed, as shown in FIG. 1C It can be appreciated there can be provided a grippable element 1650, for example a handle or abutment on the rotatable section of housing 165 that can be gripped by the user to rotate the section of housing 165 inside the housing 12, as shown in FIGS. 1B and 1C.

However the device of the invention is not limited to the housing itself constituting or providing the actuator. There may be provided a separate actuator which is operated by a user to deploy the roll of lint-removing material, i.e. to remove the protective housing cover from the sticky material so that the device may be used.

Figure 2A:
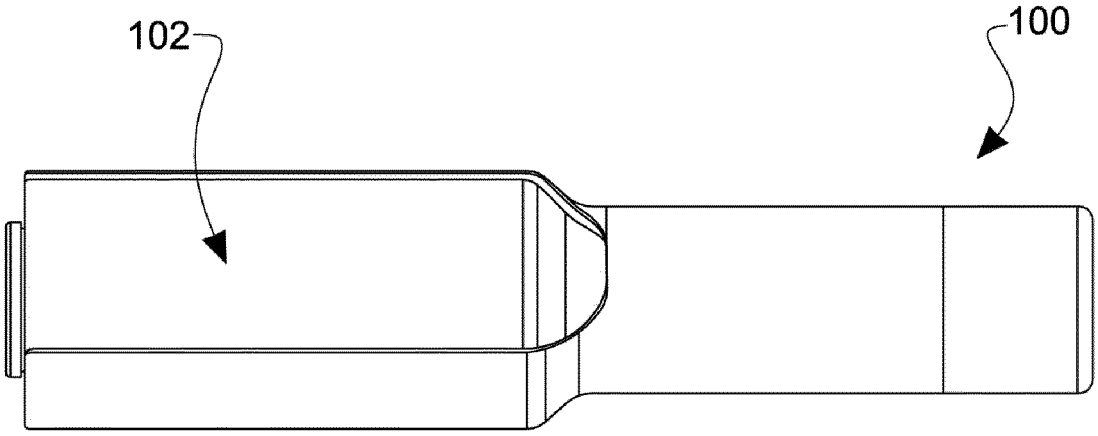
FIG. 2A is a side view of an arrangement of the invention.
Figure 2B:
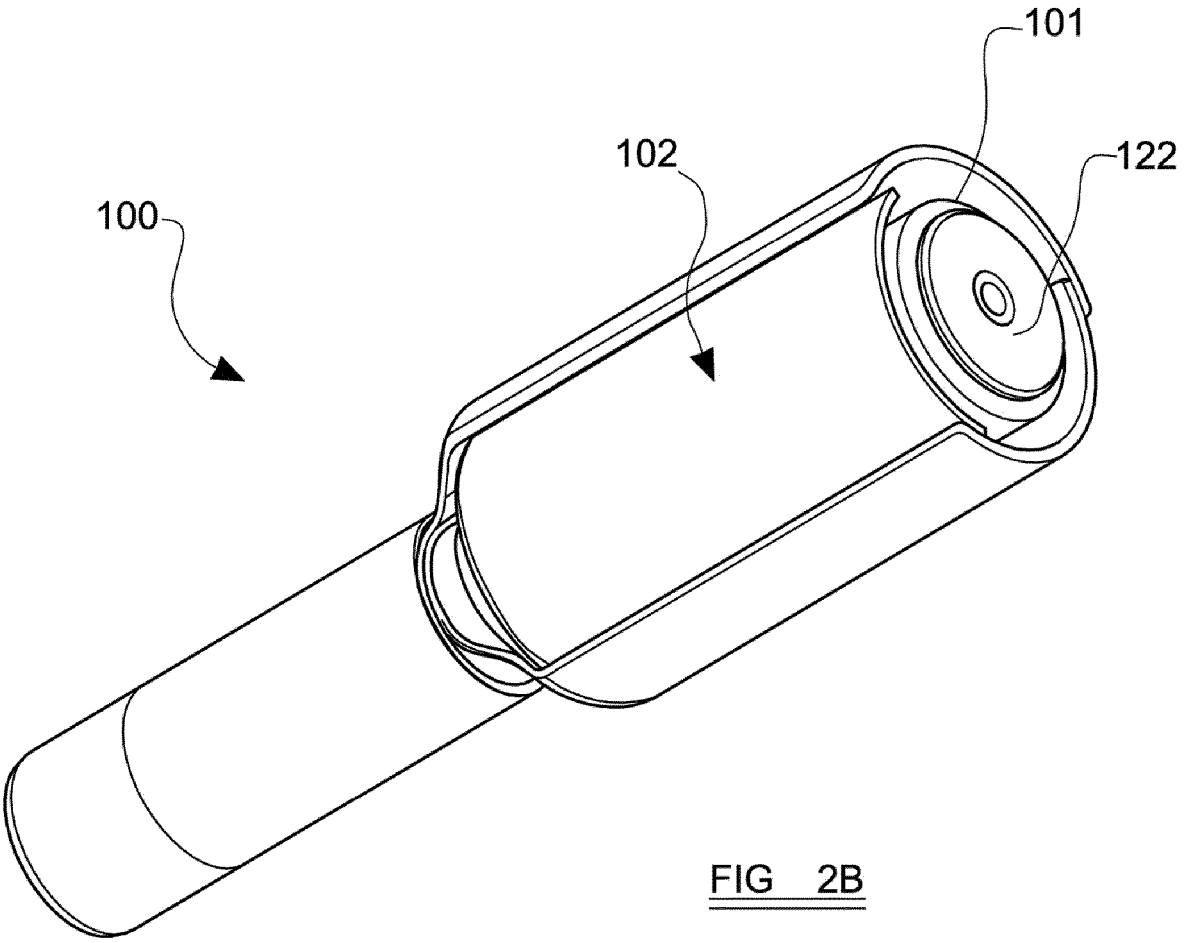
FIG. 2B is a perspective view of the arrangement of FIG. 2A.

Accordingly, a further general concept of the present invention and illustrated in FIGS. 2A-2B is a cylindrical lint-removing device 100 in which the lint-removing material is contained on a lint roller 101 which is housed within a housing 102. The housing consists of at least two parts and at least one of the two parts can rotate about the other in order to reveal the roll of lint-removing material, which is called "deployment" in the sense of the present invention.

Figure 3:
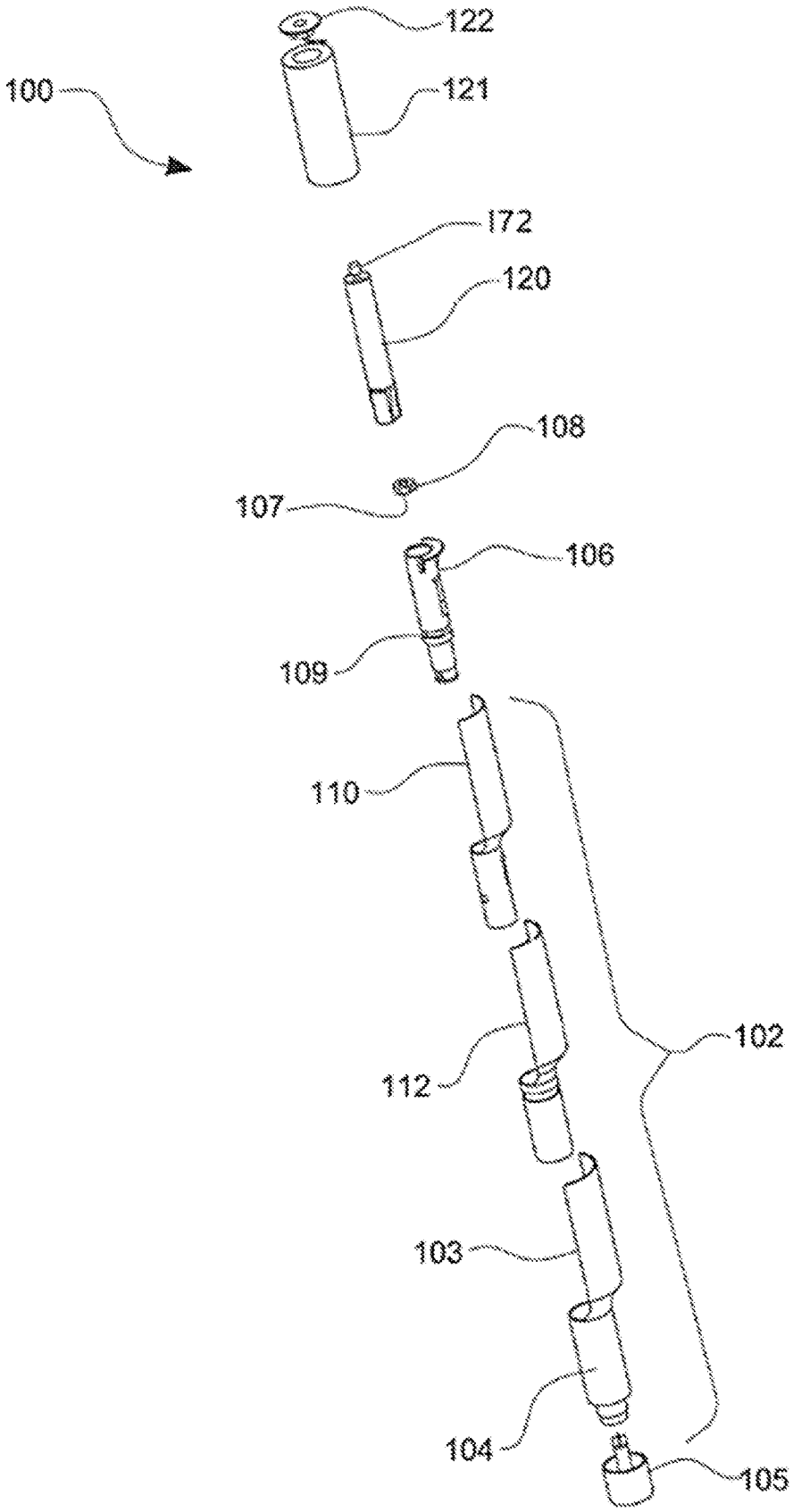
FIG. 3 is an exploded perspective view of an arrangement of the invention.
Figure 4:
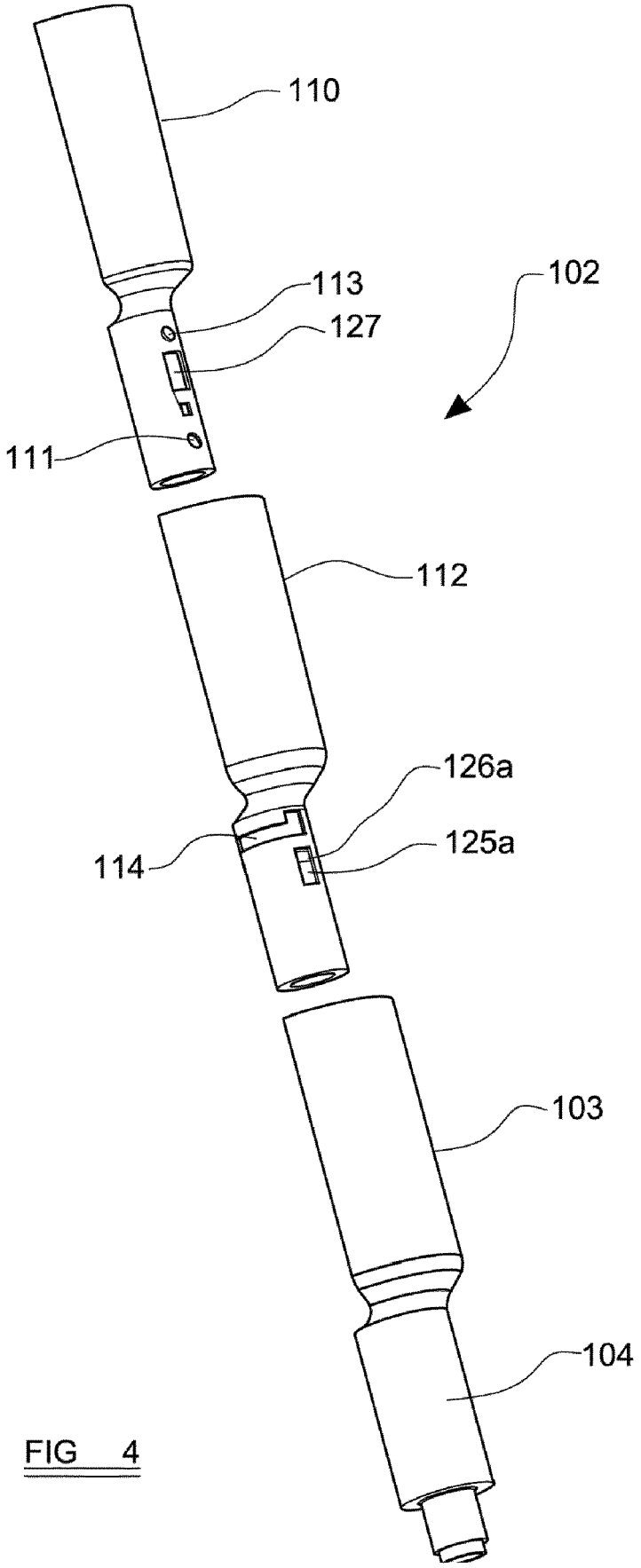
FIG. 4 is an exploded perspective view of elements of FIG. 3.
Figure 5:
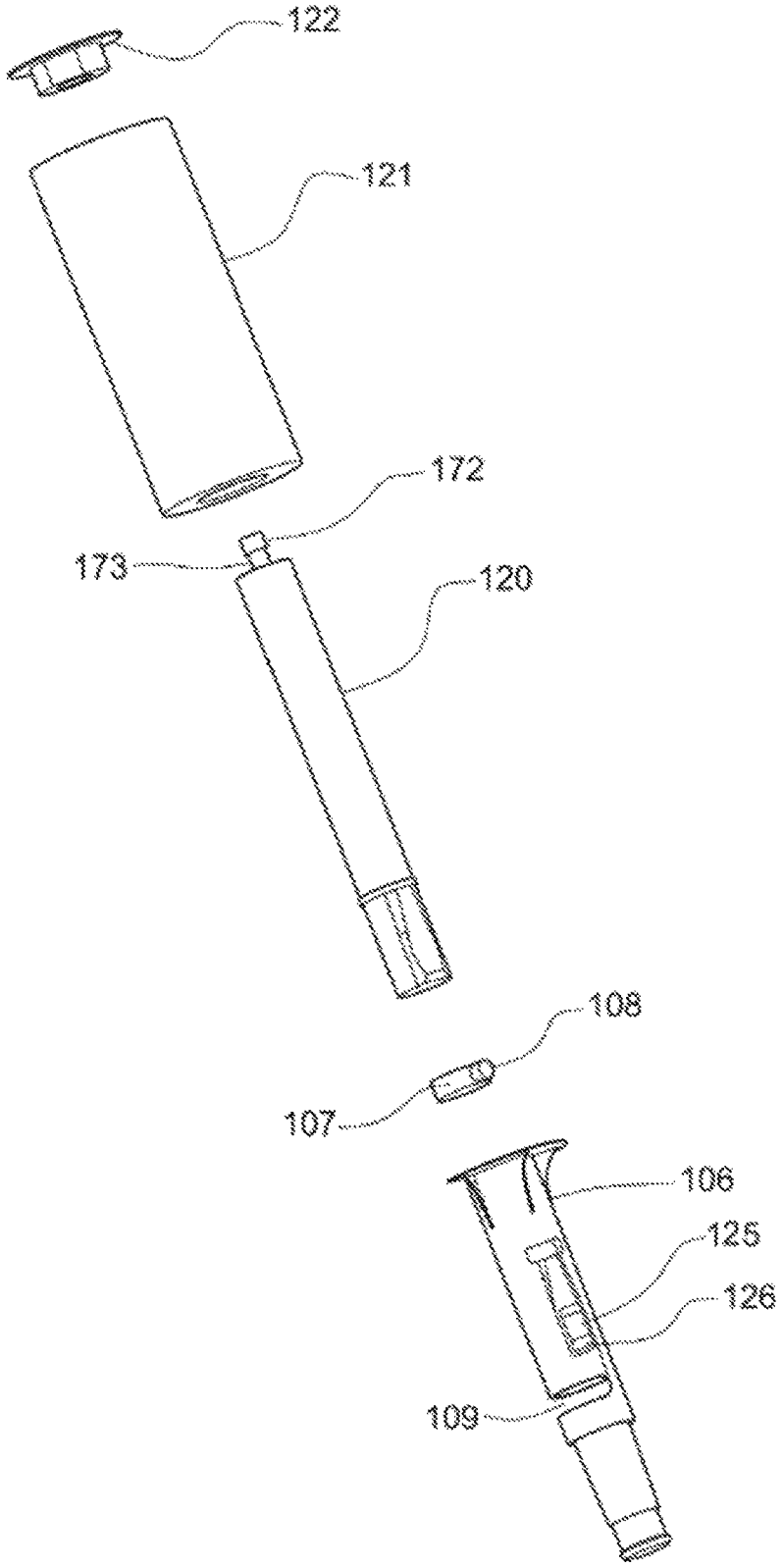
FIG. 5 is an exploded perspective view of other elements of FIG. 3.

An example of the present invention is set out in FIGS. 3-5. In this example, the cylindrical housing 102 consists of three major housing portions or segments, each one of the three parts making up 120 degrees of the total 360 degrees circumference of the cylindrical device.

The first element 103 of the housing 102 comprises a handle part 104 which is intended to be held by a user in use. The other two portions of the housing are rotatable parts which will move in use as will be described in more detail below. It is to be appreciated that the invention is not limited to just three parts of a housing. The housing could include one semi-circular (in cross-section) handle part having 180 degrees of the circumference and a single rotating part making up the other 180 degrees of the circumference. Alternatively, there could be more than three parts. Additionally, each part need not necessarily be a precise proportion of the 360 degree circumference of the cylinder. Each part could have slightly more than an exact proportion of the circumference of the device (e.g. 120 degrees as depicted in FIGS. 3-5) in order to provide an overlap between the parts.

The device also includes an actuator 105. In use, the user of the device holds the handle part 104 of the housing and rotates the actuator. The actuator is arranged to cause the movable part or parts of the housing to rotate with respect to a central axis of the overall cylindrical roller and thereby reveal the roll of lint-removing material.

As depicted, the device also includes a spindle 106 oriented along the central axis of the device, and which is connected to the first housing element 103 comprising the handle part 104 of the housing. Accordingly, in use rotation of the actuator 105 does not cause rotation of the spindle 106; rather, the spindle is associated with the handle part which is not being rotated. As will be seen from FIGS. 3 and 5, the spindle 106 is associated with a traveller 107, which is a separate element having a projection 108. The traveller is connected to the rotatable actuator 105 so that rotation of the actuator causes the traveller to rotate. The projection 108 of the traveller 107 is seated in a circumferential slot 109 of the spindle 106 so that the traveller may rotate, the extent of the rotation being determined by the two ends of the slot 109.

As depicted and described above, the traveller 107 is captured in the spindle 106 and the projection 108 is captured within the slot 109 of the spindle. The projection on the traveller is furthermore engaged through a corresponding aperture 111 formed in the neighbouring rotatable element 110 of the housing. Accordingly, rotation of the actuator causes rotation of the traveller which in turn causes the projection of the traveller to cause the first rotatable housing portion 110 to rotate. Thus, a first opening action is completed and the first rotatable portion 110 of the housing is rotated. In embodiments where there is just one static housing portion and one rotatable housing portion, this single rotation is all that is needed to rotate the housing open and deploy the lint roller 120 contained within.

As depicted here there are two rotatable housing portions 110 and 112. The first rotatable portion 110 of the housing itself contains its own projection 113 which passes into a corresponding circumferential slot 114 on the second rotatable portion 112 of the housing. When the first rotating action described above takes place, the projection of 113 the first housing portion 110 passes freely around the circumferential slot 114 of the second rotatable portion 112. However when the projection 113 of the first housing portion reaches a slot end, continued rotation (ultimately from the actuator) thus causes the second rotatable portion 112 of the housing to rotate. Thus, in the same manner as the traveller 107 with respect to the first rotatable portion 110, the projection 113 on the first rotatable portion 110, when rotated, causes the second rotatable portion 112 to rotate. This is because the projection 113 on the first rotatable portion 110 is captured within the slot 114 and, when it reaches the full extent of the end of the slot causes the second housing portion to keep rotating.

In this manner, the full opening of the device 100 as depicted is effected. In summary, rotation of the actuator 105 causes rotation of the traveller 107. This causes rotation of the first rotatable portion 110 of the housing 102. The projection 113 from the first rotatable portion similarly causes the second rotatable portion 112 to rotate. It is to be appreciated therefore that the first rotatable housing portion is able to rotate through 120 degrees whereas the second portion may rotate through 240 degrees, each limited by the extremes of the respective circumferential slots 109 and 114. When the device is in use and the lint roller deployed, in the open position, the first and second rotatable housing portions are in a position coaxial with the first (static) housing element so that around 240 degrees of the lint roller is exposed.

Neighbouring portions of the device, namely the handle portion, first rotatable portion and second rotatable portion of the housing may be provided with a friction fit which needs to be overcome by the user. Thus, when the device is in the closed configuration (depicted in FIGS. 2A and 2B) the handle portion 104 and first and second rotatable portions 110, 112 are locked into place by way of friction fits. Rotation of the actuator 105 by the user overcomes the force of the friction fit so that the portions may rotate as described above. This prevents the portions of the housing rotating inadvertently (either opening when not needed or closing when not needed).

The friction fit may be a simple smooth projection or convex bump which projects from one element into a corresponding concave depression in another element. A small amount of force from the user causes the projection to disengage from the depression. Alternatively, and as depicted, the friction fit may involve a rectangle 125, 125*a* of the element being cut out along three sides to produce a resilient region having a projection 126, 126*a*, which fits into a depression or an aperture 127 on the other element as explained previously.

Connected to the end of the spindle is a roller 120 for holding the roll 121 of lint-removing material. This is static because it is connected to the static spindle. A roll of lint-removing material 121 may be placed on the roller and may be freely rotatable as described above, to fulfil the role of removing lint. At the extremity of the device is a cap 122 which closes off the roller and the end of the lint-removing material.

The cap 122 as depicted for example in FIG. 5 includes downwardly projecting circumferential flanges. This is so that the cap 122 can be clipped into place in the roll of lint-removing material 121, as best shown in FIG. 3. In the depicted example, the downwardly projecting flanges of cap 122 deform when the cap 122 is inserted into roll of lint-removing material 121 thereby forming a snap fit between cap 122 and roll 121, in a manner known in the art. Alternatively, the connection could be formed using a push fit, friction fit or any other suitable fit. As shown, the cap 122 is fixed into place within the roll of lint-removing material 121 in a non-rotating relationship. It is envisaged that a consumer could purchase refill rolls of lint-removing material 121 for the device of the invention, which refills include the roll of lint-removing material 121 together with the pre-inserted cap 122.

The cap 122 has a further role in connecting the roll of lint-removing material 121 to the roller 120. As can be seen in FIGS. 3 and 5 the roller 120 is provided at its distal end with a male connector 172 which comprises a projection and a thinned circumferential area 173. In use, the male connector 172 is located within cap 122. The cap 122 includes a corresponding female connector in order to receive the male connector 172. Insertion of the male connector 172 into the cap 122 can be by way of a snap fit, friction fit or any other connection as known in the art. However, it is important to note that the male connector 172 is rotatable within the cap 122 when the cap 122 is connected to the roller 120. For example, where the male connector 172 is connected to the cap 122 using a snap fit, internal flanges of the cap 122 which deform to provide a snap fit becomes seated in the thinnest circumferential area 173 so that the male connector 172 is captured but may still rotate within cap 122. This ensures that the roll of lint-removing material 121 is seated in place (due to capture of the male connector 172) but may still rotate for use in removing lint.

The male connector 172 must provide a reversible connection with the cap 122 so that the afore mentioned refill comprising cap 122 and roll of lint-removing material 121 can be easily removed by a user and then replaced, once the roll of lint-removing material needs to be changed.

The lint-removing material may be wound about a tube and the tube may be mounted on the roller. The tube may further be constructed of, for example, plastic or cardboard. Lint-removing materials are known in the art. Lint-removing materials can be any substance that lint can adhere to, for example an adhesive on one side of a backing material, i.e. an adhesive tape using, for example a pressure-sensitive adhesive (PSA).

Figure 6A:
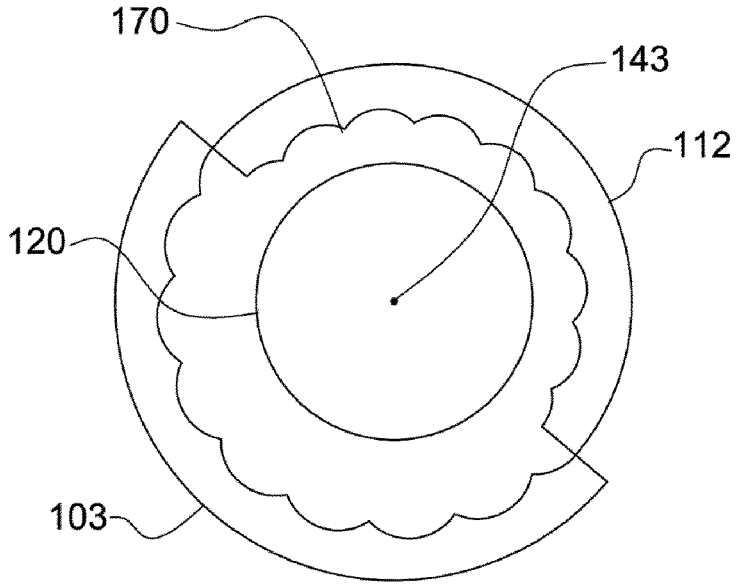
FIG. 6A is a cross-sectional view of an arrangement of the invention.
Figure 6B:
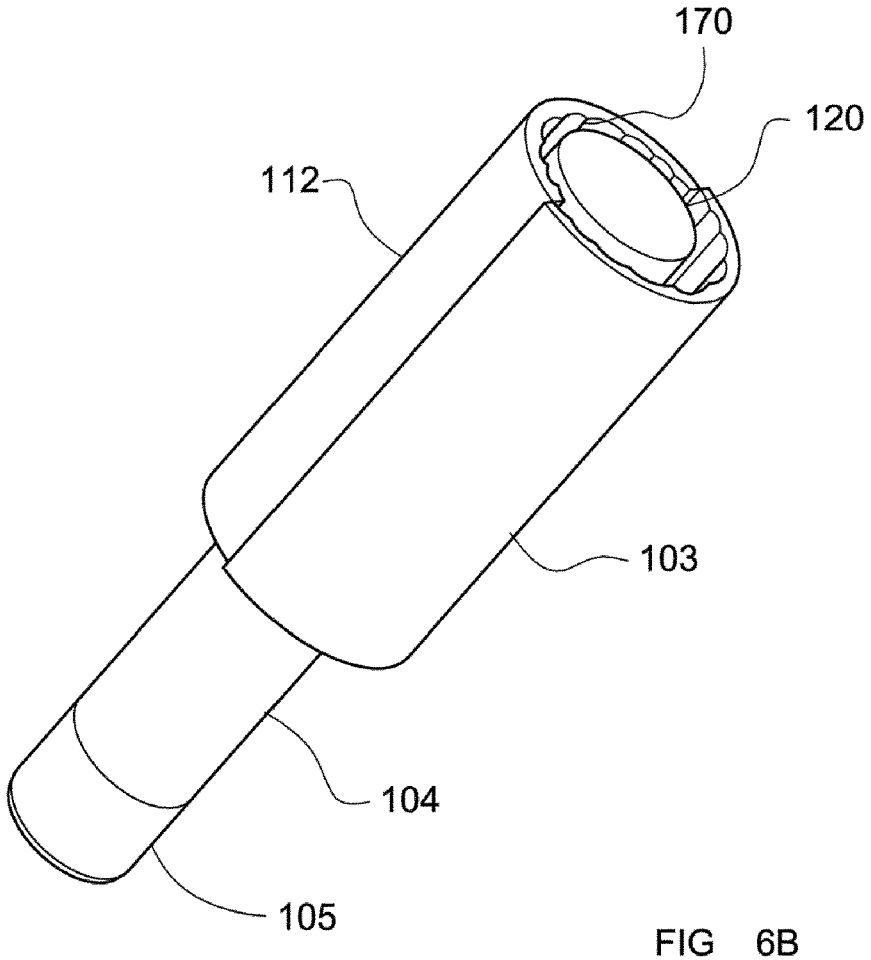
FIG. 6B is a perspective view of the arrangement of FIG. 6A.

The inner surface of the first and/or the at least one rotable housing portion of the device may comprise a plurality of projections 170 (depicted in FIGS. 6A and 6B). As depicted, the projections may take the form of ridges parallel to the axis of rotation of the rotable housing portion or portions. Projections may also take the form of ridges oriented to this axis or upwardly projecting fingers. The term "finger" means a discrete, point-like projection, which may have a circular, rectangular or some other suitable shape of cross-section. The projections act to reduce the possible surface area touching between the lint-removing material and the housing. If the roll of the lint-removing material fits loosely on the roller, any knocks to the device could cause the lint-removing material and the inner surface of the housing to come into contact. The amount of dirt and unwanted material picked up from the inner surface of the housing, on contact, is reduced by reducing the surface area of contact. It can be seen that minimising the total surface area of the projections is desirable to minimise the possibility of the lint-removing material picking up unwanted material from the housing.

Where the housing has a long axis, the projections may be made to extend along the entire long axis of the inner surface of the housing. Alternatively, the projections may only extend along part or multiple parts of the long axis of the inner surface of the housing. The preferred aspect of the present invention comprises projections extending along the entire long axis of the housing.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A device for removing lint, the device comprising:

a housing extending along a longitudinal axis and comprising a first element comprising a handle and a first housing portion;

a roller for holding a roll of lint-removing material;

wherein the roller and the roll of lint-removing material are dimensioned and configured to be housed by the housing, wherein the roller and housing are arranged such that the roller is deployable from the housing; and an actuator coupled to or formed by the housing, the actuator being manipulable by a user to deploy the roller;

wherein the handle and first housing portion extend along the longitudinal axis, wherein the handle and the actuator are coaxial with the longitudinal axis, and wherein the housing further comprises at least one rotatable housing portion which is rotatable with respect to the first housing portion in order to house or deploy the roller respectively, wherein the actuator comprises a rotatable element configured to rotate the at least one rotatable housing portion.

2. The device according to claim 1, wherein the device comprises two rotatable housing portions.

3. The device according to claim 1, wherein the device further comprises an axial spindle which is connected to or formed with the first element of the housing and wherein the axial spindle is provided with means to engage the at least one rotatable housing portion and cause the at least one rotatable housing portion to rotate.

4. The device according to claim 3, wherein the axial spindle is provided with a traveller having a projection, the traveller being connected to or formed with the actuator and the projection being configured to engage with a corresponding slot in the at least one rotatable housing portion thereby causing the rotation thereof in use.

5. The device according to claim 4, wherein the traveller is moveably seated in a circumferential slot of the spindle.

6. The device according to claim 4 wherein the corresponding slot in the at least one rotatable housing portion is a circumferential slot.

7. The device according to claim 4, wherein the device comprises a first rotatable housing portion and a second rotatable housing portion, wherein the projection engages with the first rotatable housing portion and wherein the first rotatable housing portion itself is provided with a projection configured to engage with a corresponding slot in the second rotatable housing portion, thereby causing the second rotatable housing portion to rotate when the first rotatable housing portion is rotated.

8. The device according to claim 1, wherein at least one of the handle and the at least one rotatable housing portion is provided with a friction fit, the friction fit requiring positive pressure to overcome and thereby preventing inadvertent rotation.

9. The device according to claim 8 wherein the friction fit is provided between the first housing portion and the at least one rotatable housing portion, and/or wherein two rotatable housing portions are provided and the friction fit is provided between the two rotatable housing portions.

10. The device according to claim 1, wherein an inner surface of the first housing portion and/or the at least one rotatable housing portion comprises a plurality of projections.

11. The device according to claim 10, wherein the projections are ridges parallel to an axis of rotation of the rotatable housing portion.

12. The device according to claim 10, wherein the projections are ridges non-parallel to the axis of rotation of the rotatable housing portion.

13. The device according to claim 10, wherein the projections are upwardly projecting fingers.

14. The device according to claim 10, wherein the housing has a length and the projections extend along the inner surface over the entire length of the housing, or wherein the projections extend along the inner surface over part of the length of the housing, or wherein the projections extend along the inner surface over multiple parts of the length of the housing.

15. The device according to claim 1 further comprising a cap.

16. The device according to claim 15, wherein the cap is removably attachable to the roll of lint-removing material by way of a snap fit or friction fit.

17. The device according to claim 15, wherein the cap is rotatably connectable to a male connector provided at a distal end of the roller.

18. A kit comprising the device of claim 1 and a roll of lint-removing material.

19. The kit of claim 18 further comprising a cap suitable for use with the device.

20. A device for removing lint, the device comprising:

a housing;

a roller for holding a roll of lint-removing material;

wherein the roller and the roll of lint-removing material are dimensioned and configured to be housed by the housing, wherein the roller and housing are arranged such that the roller is deployable from the housing; and an actuator coupled with or formed by either the roller or the housing, the actuator being manipulable by a user to deploy the roller;

wherein the housing comprises a first element comprising a handle and a first housing portion, wherein the housing further comprises at least one rotatable housing portion which is rotatable with respect to the first housing portion in order to house or deploy the roller respectively, and wherein the device further comprises an axial spindle which is connected to or formed with the first element of the housing and wherein the axial spindle is provided with means to engage the at least one rotatable housing portion and cause the at least one rotatable housing portion to rotate.

* * * * *